United States Patent [19]

Sato et al.

[11] Patent Number: 4,657,848

[45] Date of Patent: Apr. 14, 1987

[54] HEAT-DEVELOPABLE LIGHT-SENSITIVE MATERIAL

[75] Inventors: Kozo Sato; Yoshiharu Yabuki; Hiroyuki Hirai; Ken Kawata, all of Kanagawa, Japan

[73] Assignee: Fuji Photo Film Co., Ltd., Kanagawa, Japan

[21] Appl. No.: 782,811

[22] Filed: Oct. 2, 1985

[30] Foreign Application Priority Data

Oct. 2, 1984 [JP] Japan ..... 59-206833

[51] Int. Cl.[4] ..... G03C 1/02

[52] U.S. Cl. ..... 430/617; 430/619; 430/620; 430/607; 430/171; 430/151; 430/495; 430/955; 430/551; 430/559; 430/562; 430/203; 430/351; 430/353

[58] Field of Search ..... 430/619, 617, 620, 955, 430/607, 551, 559, 562, 495, 171, 174, 151, 203, 351, 353

[56] References Cited

U.S. PATENT DOCUMENTS 3,220,846 11/1965 Tinker et al. ..... 430/619

4,499,172 2/1985 Hirai et al. ..... 430/619

*Primary Examiner*—Won H. Louie

*Attorney, Agent, or Firm*—Sughrue, Mion, Zinn, Macpeak & Seas

[57] ABSTRACT

A heat-developable light-sensitive material is described, containing a compound represented by formula (I)

(I)

wherein $R_1$ represents a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, a substituted or unsubstituted heterocyclic group, a substituted or unsubstituted alkylene group, a substituted or unsubstituted cycloalkylene group, a substituted or unsubstituted alkenylene group, a substituted or unsubstituted alkynylene group, a substituted or unsubstituted aralkylene group, a substituted or unsubstituted arylene group, or a substituted or unsubstituted divalent heterocyclic group; $R_2$ represents a hydrogen atom, a substituted or unsubstituted alkyl group; $R_3$ represents an alkyl group, an alkoxyl group, a halogen atom, an acylamino group, a sulfonylamino group, an alkylamino group, a dialkylamino group, an alkylsulfonyl group, an arylsulfonyl group, a cyano group, a substituted or unsubstituted carbamoyl group, a substituted or unsubstituted sulfamoyl group or an alkoxycarbonyl group; X represents a divalent group selected from (wherein $R_4$ represents a hydrogen atom, a substituted or unsubstituted alkyl group), (wherein $R_5$ represents a substituted or unsubstituted alkyl group), and M represents an alkali metal, an alkaline earth metal, a quaternary ammonium group, or an ammonium group represented by BH (wherein B represents an organic base); l is an integer of 0 to 3; and m and n are each an integer of 1 or 2, such that the electric charge of carboxylate anion is equivalent to that of M.

This material is improved in activity and storage stability. That is, the material providing an image of high density and decreased fog, and which even when stored under high temperature/high humidity conditions, maintained good photographic performance.

16 Claims, No Drawings

HEAT-DEVELOPABLE LIGHT-SENSITIVE MATERIAL

FIELD OF THE INVENTION

The present invention relates to a heat-developable light-sensitive material, and more particularly, to a heat-developable light-sensitive material containing a base precursor, which is improved in activity and storage stability.

BACKGROUND OF THE INVENTION

In a heat-developable light-sensitive material, it is desirable to use a base in order to accelerate development by heat, and to increase the stability of the light-sensitive material, it is necessary to use the base in the form of a precursor. In practice, such base precursors are required to satisfy both requirements of high stability at ordinary temperature (e.g., 20° C.) and rapid decomposability at the time of heating.

Base precursors which have heretofore been known include ureas as described in U.S. Pat. No. 2,732,299 and Belgian Pat. No. 625,554, ammonium salts of urea or urea and weak acids as described in Japanese Patent Publication No. 1699/65, hexamethylenetetramine and semicarbazide as described in U.S. Pat. No. 3,157,503, triazine compounds and carboxylic acids as described in U.S. Pat. No. 3,493,374, dicyandiamide derivatives as described in U.S. Pat. No. 3,271,155, N-sulfonylureas as described in U.S. Pat. No. 3,420,665, amineimides as described in *Research Disclosure,* RD No. 15776 (1977), and salts of heat-decomposable acids such as trichloroacetic acid as described in British Pat. No. 998,949.

However, image-forming materials containing such base precursors have serious disadvantages. One of the disadvantages is that the base precursors fail to satisfy the above requirements of high stability during storage at ordinary temperatures and rapid decomposition during the process of development. Therefore, a high image density cannot be obtained, or the base is released during the storage, leading to a serious decrease in the density/fog ratio of the image.

In order to overcome the above problem, Japanese Patent Application (OPI) No. 168441/84 (the term "OPI" as used means a "published unexamined Japanese patent application") discloses sulfonylacetic acid salts, and Japanese Patent Application No. 55700/83, propiol acid salts. These base precursors are excellent in that a high density image can be obtained in a short period of time. With respect to the stability during the storage, however, they are not sufficiently satisfactory. In particular, they have a disadvantage in that when light-sensitive materials containing them are stored at high temperatures, the formation of fog is significant and desensitization is large.

SUMMARY OF THE INVENTION

The present invention is intended to overcome the above problems.

An object of the present invention is to provide a heat-developable light-sensitive material which can produce a high density image in a short period of time.

Another object of the present invention is to provide a heat-developable light-sensitive material which can produce an image having a high density/fog ratio, that is, high density and decreases fog.

Still another object of the present invention is to provide a heat-developable light-sensitive material which is excellent in stability and particularly showing decreased changes of photographic performance even when stored under high temperature and high humidity conditions.

It has been found that the above objects can be attained by using specific compounds as described hereinafter.

The present invention relates to a heat-developable light-sensitive material containing a compound represented by formula (I)

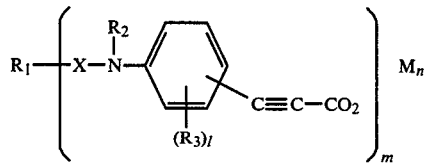

(I)

wherein $R_1$ represents a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, a substituted or unsubstituted heterocyclic group, a substituted or unsubstituted alkylene group, a substituted or unsubstituted cycloalkylene group, a substituted or unsubstituted alkenylene group, a substituted or unsubstituted alkynylene group, a substituted or unsubstituted aralkylene group, a substituted or unsubstituted arylene group, or a substituted or unsubstituted divalent heterocyclic group; $R_2$ represents a hydrogen atom, a substituted or unsubstituted alkyl group; $R_3$ represents an alkyl group, an alkoxyl group, a halogen atom, an acylamino group, a sulfonylamino group, an alkylamino group, a dialkylamino group, an alkylsulfonyl group, an arylsulfonyl group, a cyano group, a substituted or unsubstituted carbamoyl group, a substituted or unsubstituted sulfamoyl group or an alkoxycarbonyl group; X represents a divalent group selected from

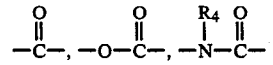

(wherein $R_4$ represents a hydrogen atom, a substituted or unsubstituted alkyl group),

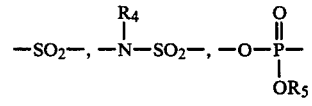

(wherein $R_5$ represents a substituted or unsubstituted alkyl group), and

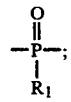

M represents an alkali metal, an alkaline earth metal, a quaternary ammonium group, or an ammonium group represented by BH (wherein B represents an organic base); l is an integer of 0 to 3; and m and n are each an integer of 1 or 2, such that the electric charge of carboxylate anion is equivalent to that of M.

DETAILED DESCRIPTION OF THE INVENTION

Formula (I) is hereinafter explained in more detail.

In formula (I), $R_1$ represents, as described above, a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, a substituted or unsubstituted heterocyclic group, a substituted or unsubstituted alkylene group, a substituted or unsubstituted cycloalkylene group, a substituted or unsubstituted alkenylene group, a substituted or unsubstituted alkynylene group, a substituted or unsubstituted aralkylene group, a substituted or unsubstituted arylene group, or a substituted or unsubstituted divalent heterocyclic group.

Preferably, $R_1$ represents a hydrogen atom, an alkyl group having from 1 to 11 carbon atoms (e.g., a methyl group, an isopropyl group, and a tert-butyl group), an aryl group (e.g., a phenyl group, a p-chlorophenyl group, and a p-methoxyphenyl group), a cycloalkyl group having from 5 to 8 carbon atoms (e.g., a cyclopentyl group, and a cyclohexyl group), an aralkyl group having from 7 to 12 carbon atoms (e.g., a benzyl group, and a β-phenetyl group), an alkylene group having from 1 to 8 carbon atoms (e.g., a methylene group, an ethylene group, and a trimethylene group), an arylene group having from 6 to 10 carbon atoms (e.g., an o-phenylene group, a m-phenylene group, a p-phenylene group, and a 1,5-naphthelene group), a styryl group, a 2-thienyl group, or a 2-furyl group.

$R_2$ represents a hydrogen atom, a substituted or unsubstituted alkyl group. Preferably, $R_2$ represents a hydrogen atom.

$R_3$ represents an alkyl group, an alkoxyl group, a halogen atom, an acylamino group, a sulfonylamino group, an alkylamino group, a dialkylamino group, an alkylsulfonyl group, an arylsulfonyl group, a cyano group, a substituted or unsubstituted carbamoyl group, a substituted or unsubstituted sulfamoyl group, or an alkoxycarbonyl group. Preferably, $R_3$ represents a methyl group, a methoxy group, a methoxyethoxy group, a halogen atom, an acylamino group having from 1 to 8 carbon atoms, an alkylsulfonylamino group having from 1 to 8 carbon atoms, or an arylsulfonylamino group having from 6 to 7 carbon atoms.

X represents

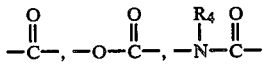

(wherein $R_4$ represents a hydrogen atom, a substituted or unsubstituted alkyl group),

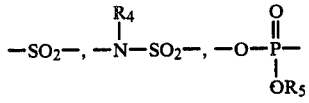

(wherein $R_5$ represents a substituted or unsubstituted alkyl group), or

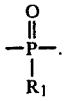

Preferably, X represents

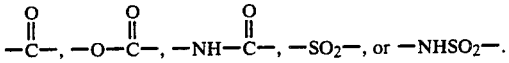

M represents an alkali metal, an alkaline earth metal, a quaternary ammonium group, or an ammonium group represented by BH (wherein B represents an organic base). Preferably, M is $Na^{\oplus}$, $K^{\oplus}$, $Cs^{\oplus}$, $Ba^{\oplus}$, a quaternary ammonium salt having a total number of carbon atoms of 8 or less, or an ammonium group represented by BH. Preferred examples of the organic base represented by B are those having a pKa of 7 or more and a number of carbon atoms of 12 or less. Particularly preferred are low volatility bases having a pKa of 10 or more and a boiling point at atmospheric pressure of 150° C. or more, such as guanidines, cyclic guanidines, amidines, and cyclic amidines.

Examples of base precursors which are preferably used in the present invention are shown below.

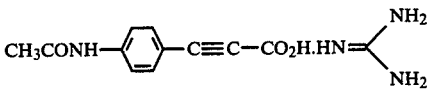

(1)

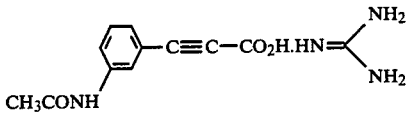

(2)

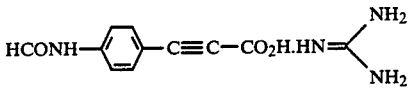

(3)

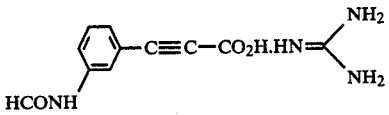

(4)

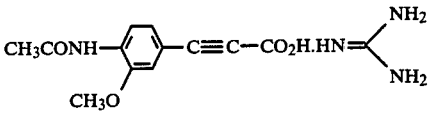

(5)

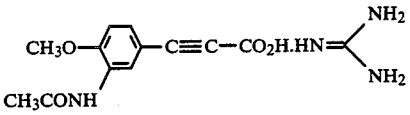

(6)

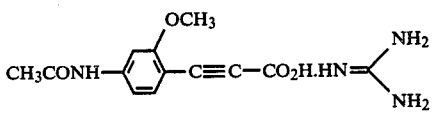

(7)

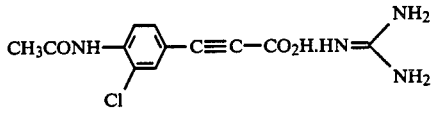

(8)

-continued
(9)
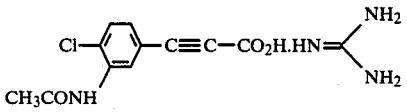
(10)
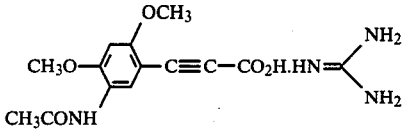
(11)
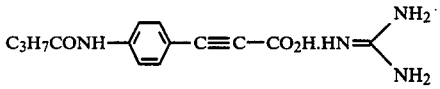
(12)
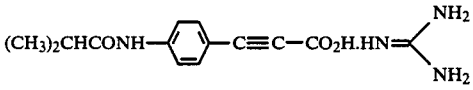
(13)
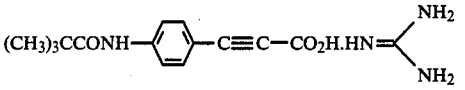
(14)
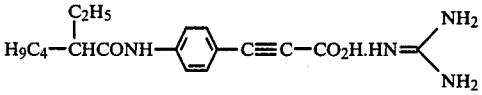
(15)
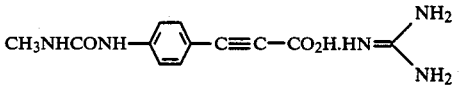
(16)
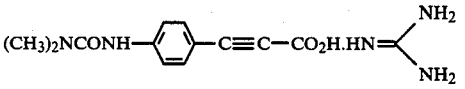
(17)
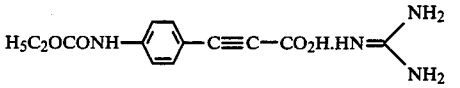
(18)
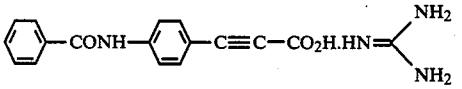
(19)
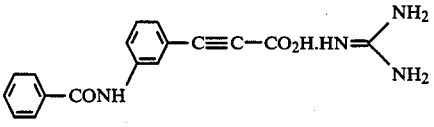
(20)
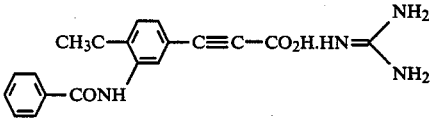
(21)
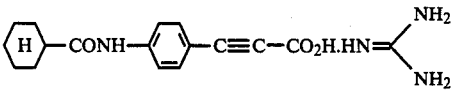
(22)
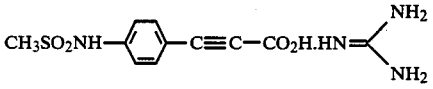
-continued
(23)
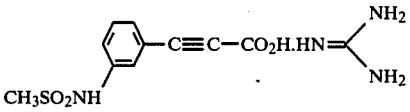
(24)
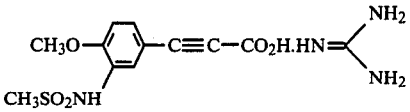
(25)
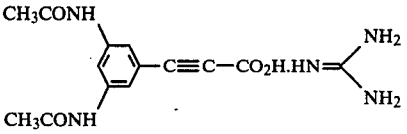
(26)
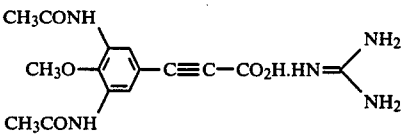
(27)
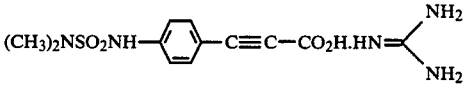
(28)
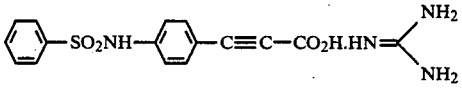
(29)
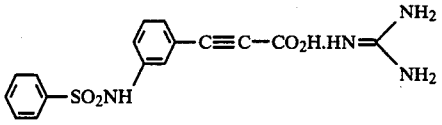
(30)
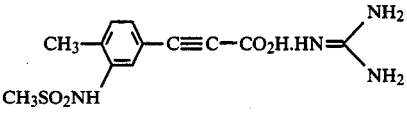
(31)
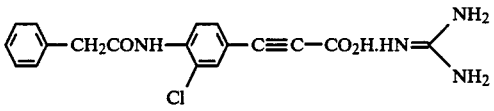
(32)
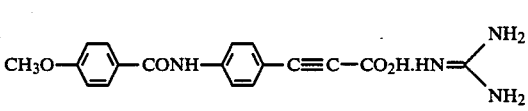
(33)
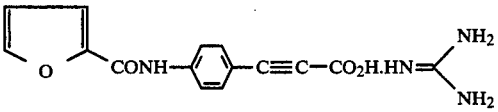
(34)
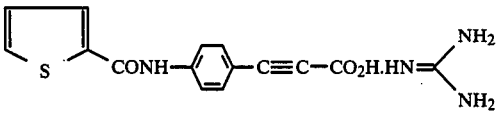
(35)
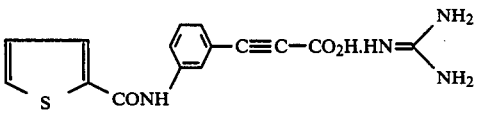

-continued
(36)
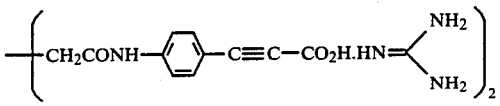
(37)
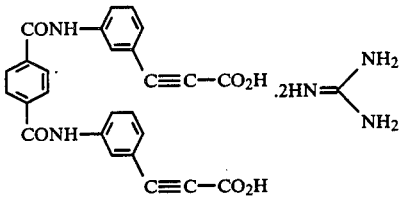
(38)
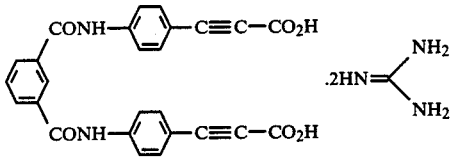
(39)
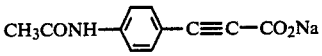
(40)
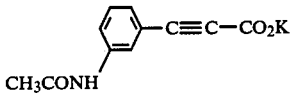
(41)
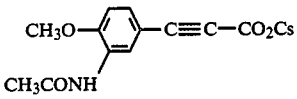
(42)
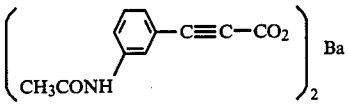
(43)
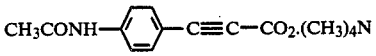
(44)
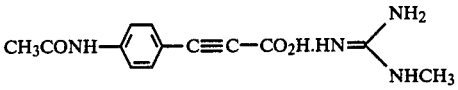
(45)
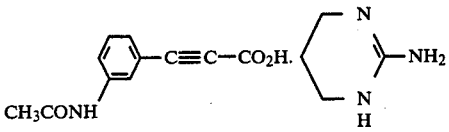
(46)
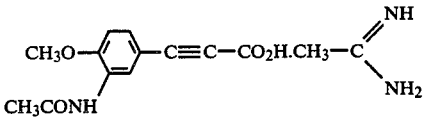
(47)
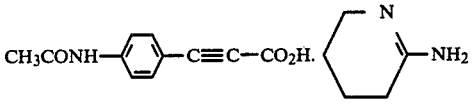
The base precursor of the present invention can be prepared according to scheme A or scheme B, as described below.
Scheme A:
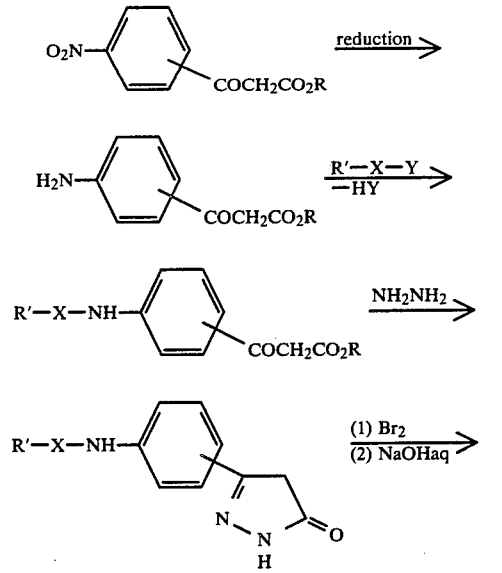
Scheme B:
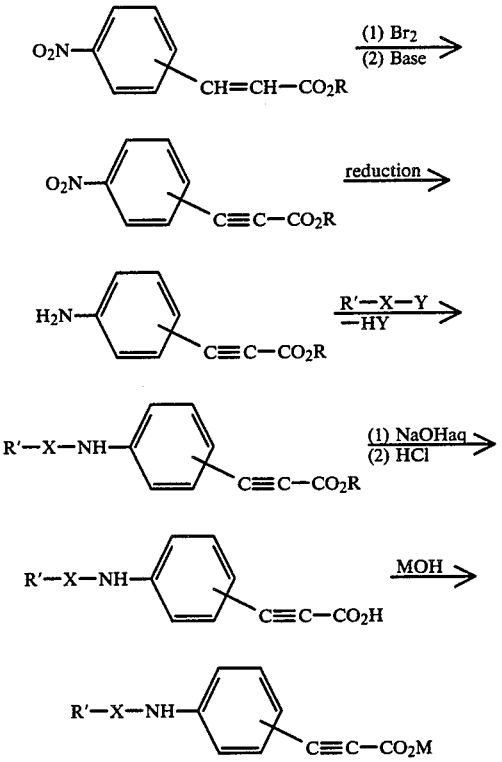

One preparation example is shown below to illustrate a method of preparation of the base precursor of the present invention.

PREPARATION EXAMPLE

Preparation of Compound (1)

A mixture of 224 g of reduced iron, 13.4 g of ammonium chloride, 1,000 ml of isopropyl alcohol, and 200 ml of water was prepared, and then 237 g of ethyl p-nitrobenzoylacetate was added thereto in small amounts at temperatures ranging between 50° and 70° C. They were reacted at 70° C. for 1 hour and then the reaction solution was filtered. Then, 1,000 ml of water was added to the filtrate and cooled to 5° C., and crystals precipitated were collected by filtration to yield 172 g of yellow ethyl p-aminobenzoylacetate crystals, m.p., 82°–4° C.

Ethyl p-aminobenzoylacetate (146 g) was dissolved in 440 ml of acetonitrile, and then 70 ml of anhydrous acetic acid was added dropwise thereto at 40° C.

They were reacted at 40° C. for 1 hour, and then 48.8 g of 80% hydrazine hydrate was dropped thereto. After the generation of heat decreased, the reaction was performed for 1 hour at temperatures ranging between 55° and 60° C. The resulting mixture was cooled to 5° C. and crystals formed were separated by filtration to yield 148 g of gray crystals of 3-(4-acetylaminophenyl)-2-pyrazoline-5-one, m.p., 254°–8° C.

These crystals (69 g) were mixed with 330 ml of acetonitrile, and 33.4 ml of bromine was dropped to the mixture at a temperature of 15° C. or less. The mixture was stirred for 1 hour, and then the yellow mixture thus obtained was dropped to 500 ml of an aqueous solution containing 76 g of sodium hydroxide at a temperature of 15° C. or less. The resulting mixture was allowed to stand overnight, and then water was added to make 2,000 ml, and 90 ml of 35% hydrochloric acid was slowly added dropwise thereto. Yellow crystals that precipitated were separated by filtration, and then thoroughly washed with water to yield crude crystals of p-acetylaminophenylpropiolic acid.

These crude crystals were added to a solution prepared by dissolving 14 g of sodium hydroxide in 140 ml of water. The mixture was stirred at 40° C. for 30 minutes. Upon addition of 45 g of salt, sodium p-acetylaminopropiolate precipitated. The precipitate was cooled to 10° C. and then separated by filtration. On washing thoroughly with a saturated salt solution, white crystals were obtained. These crystals were added to 400 ml of hot water maintained at 50° C., and insoluble materials were removed by filtration. Upon addition of 30 ml of hydrochloric acid to the filtrate, white crystals precipitated. These crystals were separated by filtration to yield 42.5 g of p-acetylaminophenylpropiolic acid, m.p., 183°–5° C. (decomposition).

These crystals (42 g) were mixed with 84 ml of methanol, and the resulting mixture was neutralized by carefully adding an aqueous solution containing 18.8 g of guanidine carbonate. The reaction solution was cooled to 5° C., and crystals precipitated were separated by filtration and then thoroughly washed with 42 ml of cooled methanol. The light-yellow crystals thus obtained were dried at a temperature of 50° C. or less to yield 44 g of Compound (1), m.p., 191°–2° C. (decomposition).

Other compounds as shown above can be easily prepared in the same general manner as above. The melting points of typical compounds are shown in the table below.

| Compound | Melting Point |
|---|---|
| (1) | 191–2° C. (decomposition) |
| (2) | 73–4° C. |
| (6) | 174–5° C. (decomposition) |
| (11) | 177–8° C. (decompositon) |

The effect of the base precursor of the present invention is exhibited markedly when it is used in combination with a chemically sensitized light-sensitive silver halide emulsion. That is, the base precursor of the present invention greatly increases, particularly in image density, when used in combination with such chemically sensitized light-sensitive silver halide emulsions.

Chemical sensitization is performed using, for example, methine dyes. Dyes which can be used for this chemical sensitization include cyanine dyes, merocyanine dyes, composite cyanine dyes, composite merocyanine dyes, holo-polar cyanine dyes, hemicyanine dyes, styryl dyes, and hemioxonol dyes. Particularly useful dyes are cyanine dyes, merocyanine dyes, and composite merocyanine dyes. Any of the nuclei commonly utilized as basic heterocyclic nuclei in cyanine dyes can be applied to the above dyes. That is, a pyrroline nucleus, an oxazoline nucleus, a thiazoline nucleus, a pyrrole nucleus, an oxazole nucleus, a thiazole nucleus, a tetrazole nucleus, a pyridine nucleus, etc.; nuclei resulting from the fusion of alicyclic hydrocarbon rings to the above nuclei; and nuclei resulting from the fusion of aromatic hydrocarbon rings to the above nuclei, such as an indolenine nucleus, a benzindolenine nucleus, an indole nucleus, a benzoxazole nucleus, a naphthoxazole nucleus, a benzothiazole nucleus, a naphthothiazole, a benzoselenazole nucleus, a benzinidazole nucleus, and a quinoline nucleus, can be applied. These nuclei may include substituents on the carbon atom thereof.

To merocyanine dyes or composite merocyanine dyes, 5- or 6-membered heterocyclic nuclei, such as a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbitulic acid nucleus can be applied as nuclei having a ketomethylene structure.

These sensitizing dyes may be used alone or in combination with each other. Such combinations are often used for the purpose of supersensitization.

Useful sensitizing dyes are described, for example, in West German Patent No. 929,080, U.S. Pat. Nos. 2,493,748, 2,503,776, 2,519,001, 2,912,329, 3,656,959, 3,672,897, 3,694,217, 4,025,349, 4,046,572, British Patent No. 1,242,588, Japanese Patent Publication Nos. 14030/69 and 24844/77.

The amount of the sensitizing dye used is appropriately from 0.001 to 20 g per 100 g of silver used in the preparation of the emulsion, with the range of 0.01 to 2 g being preferred.

The base precursor of the present invention can be used in a wide range of amount. The amount of the base precursor used is generally 50 wt% or less, and preferably from 0.01 to 40 wt%, based on the weight of the dry light-sensitive material.

The light-sensitive material of the present invention may take various unit and layer structures. The base precursor may be incorporated in various layers of the light-sensitive material. If a light-sensitive emulsion layer and a dye-providing substance-containing layer are provided separately, the base precursor may be added to such layers.

In addition, the base precursor may be added to an intermediate layer or protective layer.

These base precursors may be used as mixtures comprising two or more thereof.

In the present invention, silver halide is used as a light-sensitive substance.

Silver halide includes silver chloride, silver chlorobromide, silver chloroiodide, silver bromide, silver iodobromide, silver chloroiodobromide, and silver iodide.

Silver iodobromide, for example, can be prepared by adding a silver nitrate solution to a potassium bromide solution to prepare silver bromide particles and then adding potassium iodide.

Two or more types of silver halide having different sizes and/or silver halide compositions may be used in combination with each other.

In connection with the size of silver halide particles, the average particle diameter is preferably from 0.001 to 10 μm and preferably from 0.001 to 5 μm.

Silver halide that is used in the present invention may be used as it is, or be chemically sensitized with the compounds of sulfur, selenium, tellurium, etc., or a chemical sensitizing agent (e.g., compounds of platinum, gold, palladium, rhodium, iridium, etc.), a reducing agent (e.g., tin halide), or a combination thereof. Details are described in T. H. James, *The Theory of the Photographic Process,* 4th ed., 1977, Chapter 5, pp. 149–169.

The amount of light-sensitive silver halide coated is appropriately from 1 mg to 10 g/m$^2$ (calculated as silver).

In a particularly preferred embodiment of the light-sensitive material of the present invention, an organosilver salt is used in combination with silver halide.

When heated to a temperature of 80° C. or more, preferably 100° C. or more in the presence of imagewise exposed silver halide, the organosilver salt reacts with an image-forming substance or a reducing agent, if necessary, added in combination with the image-forming substance, thereby forming a silver image. By using such organosilver salt oxidizing agents, a light-sensitive material producing a high density color image can be obtained.

In this case, it is not always necessary for silver halide to have a feature that pure silver iodide crystals are contained as required when silver halide is used alone. All types of silver known in the art can be used.

Examples of such organosilver salt oxidizing agents are described in Japanese Patent Application (OPI) No. 58543/83. For example, the silver salts of organic compounds having a carboxyl group can be used. Typical examples of the silver salts are silver salts of aliphatic carboxylic acids and aromatic carboxylic acids.

In addition, the silver salts of compounds having a mercapto group or thione group, or derivatives thereof, can be used.

Other compounds which can be used include silver salts of compounds having an imino group. For example, the silver salts of benzotriazole and derivatives thereof, as described in Japanese Patent Publication Nos. 30270/69 and 18416/70, the silver salts of alkyl-substituted benzotriazoles, such as methylbenzotriazole, the silver salts of halogen-substituted benzotriazoles, such as 5-chlorobenzotriazole, the silver salts of carboimidobenzotriazoles, such as butylcarboimidobenzotriazole, the silver salts of 1,2,4-triazole and 1-H-tetrazole, as described in U.S. Pat. No. 4,220,709, carbazole silver salts, saccharine silver salts, and silver salts of imidazole and derivatives thereof can be used.

Organometallic salts such as silver salts and copper stearate as described in *Research Disclosure,* RD No. 17029 (June, 1978) are among the organometal salt oxidizing agents that can be used in the present invention.

A method of preparation of such silver halide and organosilver salts, a method of mixing them, and so forth are described in *Research Disclosure,* RD No. 17029 (June, 1978), Japanese Patent Application (OPI) Nos. 32928/75, 42529/76, 13224/74 and 17216/75, and U.S. Pat. No. 3,700,458.

The total amount of light-sensitive silver halide and organosilver salt being coated is appropriately from 50 milligrams to 10 grams per squre meter (calculated as silver).

In the present invention, silver may be used as an image-forming substance, or various image-forming substances can be used in various manners.

Examples include couplers which react with the oxidized products of developing agents used in the known liquid development, thereby forming a color image. For example, as magenta couplers, a 5-pyrazolone coupler, a pyrazolobenzimidazole coupler, a cyanoacetylcumarone coupler, and an open chain acylacetonitrile coupler can be used; as yellow couplers, an acylacetamide coupler (e.g., benzoylacetoanilides and pivaloylacetoanilides) and the like can be used; and as cyan couplers, a naphthol coupler, a phenol coupler, and the like can be used. It is desirable for these couplers to be nondiffusing, i.e., to have a hydrophobic group called a ballast group in the molecule thereof, or to be polymerized. These couplers may be 4-equivalent or 2-equivalent in relation to silver ions.

Colored couplers having the effect of color correction, or couplers releasing a development inhibitor with the progress of development (so-called DIR couplers) can also be used.

Dyes forming a positive color image by the light-sensitive silver dye bleaching method, such as dyes as described in *Research Disclosure,* RD No. 14433 (April, 1976), pp. 30–32, ibid, RD No. 15227 (Dec., 1976), pp. 14–15, and U.S. Pat. No. 4,235,957, and leuco dyes as described in U.S. Pat. Nos. 3,985,565 and 4,022,617 can also be used.

Dyes with a nitrogen-containing heterocyclic group incorporated therein as described in *Research Disclosure,* RD No. 16966 (May, 1978), pp. 54–58 can be used.

In addition, dye-providing substances releasing a mobile dye by utilizing a coupling reaction with silver halide or a reducing agent oxidized through an oxidation/reduction reaction with an organosilver salt at high temperatures as described in European Patent No. 79,056, West German Patent No. 3,217,853, and European Patent No. 67,455, and dye-providing substances releasing a mobile dye as a result of an oxidation/reduction reaction with silver halide or an organosilver salt at high temperatures as described in European Patent No. 76,492, West German Patent No. 3,215,485, European Patent No. 66,282, Japanese Patent Application Nos. 28928/83 and 26008/83 can be used.

Preferred examples of the dye-providing substance are represented by formula (CI)

Dye-W-Y (CI)

In the formula (CI), Dye represents a dye which becomes mobile when released from the dye-providing substance. This dye preferably has a hydrophilic group. Dyes which can be used include an azo dye, an azomethine dye, an anthraquinone dye, a naphthoquinone dye, a styryl dye, a nitro dye, a quinoline dye, a carbonyl dye, and a phthalocyanine dye. These dyes can be used in the form that is temporarily shifted in its wavelength absorption region, so as to be capable of recovering its desired color at the time of development. In more detail, dyes as described in European Patent Laid-Open No. 76,492 can be used.

W represents a bonding or connecting group, such as a group —NR— (wherein R represents a hydrogen atom, an alkyl group, or a substituted alkyl group), a group —$SO_2$—, a group —CO—, an alkylene group, a substituted alkylene group, a phenylene group, a substituted phenylene group, a naphthylene group, a substituted naphthylene group, a group —O—, a group —SO—, or a group comprising two or more of the above groups.

Y represents a group which releases Dye corresponding to or in reverse relation to a light-sensitive silver salt having an imagewise latent image, the diffusibility of the released Dye being different from that of the compound of the formula Dye-W-Y.

Y is hereinafter be explained in more detail.

Y is selected so that the compound represented by the formula (CI) is a nondiffusing image-forming compound which is oxidized as a result of development, thereby undergoing self-cleavage and providing a diffusing dye.

An effective example of this type is an N-substituted sulfamoyl group. Examples of Y include groups represented by formula (CII)

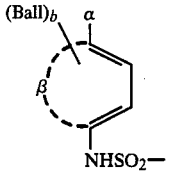

(CII)

In formula (CII), $\beta$ represents a non-metallic atomic group forming a benzene ring. This benzene ring may be condensed with a carbocyclic ring or a heterocyclic ring, to thereby form, for example, a naphthalene ring, a quinoline ring, a 5,6,7,8-tetrahydronaphthalene ring, or a cumarone ring.

$\alpha$ is a group represented by —$OG^{11}$ or —$NHG^{12}$ (wherein $G^{11}$ is a hydrogen atom or a group which is hydrolyzed, thereby releasing a hydroxyl group, $G^{12}$ is a hydrogen atom, an alkyl group having from 1 to 22 carbon atoms, or a group which acts so that $NHG^{12}$ is hydrolyzable.

Ball represents a ballast group.

b is 0, 1, or 2.

Representative examples of this type of Y are described in Japanese Patent Application (OPI) Nos. 33826/73 and 50736/78.

Other examples of Y which are suitable for the compounds of this type are groups represented by formula (CIII)

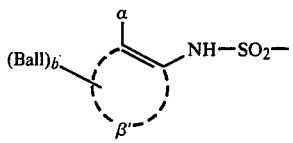

(CIII)

In formula (CIII), Ball, $\alpha$, and b are the same as defined for formula (CII).

$\beta'$ represents an atomic group forming a carbocyclic ring such as a benzene ring. The carbocyclic ring may be condensed with a carbocyclic ring or a heterocyclic ring to thereby form, for example, a naphthalene ring, a quinoline ring, a 5,6,7,8-tetrahydronaphthalene ring, or a cumarone ring.

Representative examples of Y of this type are described in Japanese Patent Application (OPI) Nos. 113624/76, 12642/81, 16130/81, 16131/81, and 4043/82, and U.S. Pat. No. 4,053,312.

Other examples of Y which are suitable for the compounds of this type are groups represented by formula (CIV)

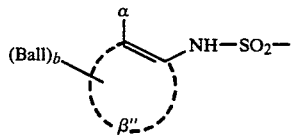

(CIV)

In formula (CIV), Ball, $\alpha$ and b are the same as defined for formula (CII).

$\beta''$ represents an atomic group forming a heterocyclic ring, such as a pyrazole ring and a pyridine ring. These heterocyclic rings may be condensed with a carbocyclic ring or a heterocyclic ring.

Representative examples of Y of this type are described in Japanese Patent Application (OPI) No. 104343/76.

Other examples of Y which are suitable for the compounds of this type are groups represented by formula (CV)

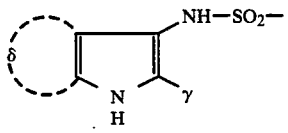

(CV)

In formula (CV), $\gamma$ is preferably a hydrogen atom, a substituted or unsubstituted alkyl group, an aryl group, a heterocyclic group, or a group —CO—$G^{21}$ (wherein $G^{21}$ is

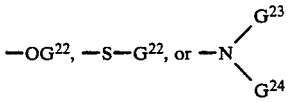

(wherein $G^{22}$ represents a hydrogen atom, an alkyl group, a cycloalkyl group, or an aryl group, $G^{23}$ represents the same group as defined above, or an acyl group derived from an aliphatic or aromatic carboxylic acid or sulfonic acid, and $G^{24}$ represents a hydrogen atom, or a substituted or unsubstituted alkyl group)).

$\delta$ is a group forming a condensed benzene ring.

Representative examples of Y of this type are described in Japanese Patent Application (OPI) Nos. 104343/76, 46730/78, 130122/79, and 85055/82.

Other examples of Y which are suitable for compounds of this type are groups represented by formula (CVI).

(CVI)

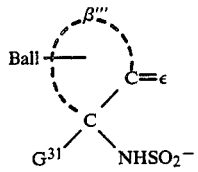

In formula (CVI), Ball is the same as defined for formula (CII).

$\epsilon$ represents an oxygen atom or a group $=NG^{32}$ (wherein $G^{32}$ represents a hydroxyl group, or an amino group which may be substituted). In this case, the compound of $H_2N\text{-}G^{32}$ includes hydroxylamines, hydrazines, semicarbazides, and thiosemicarbazides.

$\beta'''$ represents an atom group necessary for forming a 5-, 6-, or 7-membered saturated or unsaturated nonaromatic hydrocarbon ring.

$G^{31}$ represents a hydrogen atom, or a halogen atom (e.g., a fluorine atom, a chlorine atom, and a bromine atom).

Representative examples of Y of this type are described in Japanese Patent Application (OPI) Nos. 3819/78 and 48534/79.

Other examples of Y of this type are described, for example, in Japanese Patent Publication Nos. 32129/73, 39165/73, Japanese Patent Application (OPI) No. 64436/74, and U.S. Pat. No. 3,443,934.

Other examples of Y of the present invention are the groups represented by formula (CVII).

(CVII)

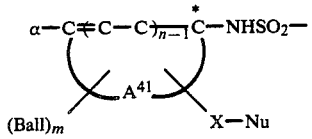

In formula (CVII), $\alpha$ is $OR^{41}$ or $NHR^{42}$ (wherein $R^{41}$ is a hydrogen atom or a hydrolyzable component, and $R^{42}$ is a hydrogen atom, an alkyl group having from 1 to 50 carbon atoms, or a group making $NHR^{42}$ hydrolyzable).

$A^{41}$ represents an atomic group forming an aromatic ring.

Ball represents an organic immobilizing group present on the aromatic ring, m is an integer of 1 or 2, and when m is 2, the Ball groups may be the same or different.

X is a divalent organic group having from 1 to 8 atoms, and a nucleophilic group (Nu) combines with an electrophilic center (carbon atom indicated by *) resulting from oxidation, thereby forming a 5 to 12-membered ring.

Nu represents a nucleophilic group.

n is an integer of 1 or 2.

$\alpha$ is the same as defined for formula (CII).

Representative examples of Y of this type are described in Japanese Patent Application (OPI) No. 20735/82.

Another type of compound represented by formula (I) are nondiffusing image-forming compounds releasing a diffusing dye as a result, for example, of self-ring closing in the presence of a base, but not substantially causing the dye release on reacting with an oxidized developing agent.

Examples of Y which are effective for the compounds of this type are the groups represented by formula (CVIII).

(CVIII)

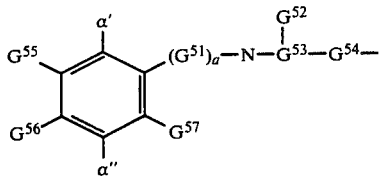

In above formula (CVIII), $\alpha'$ represents a nucleophilic group capable of being oxidized, such as a hydroxyl group, a primary or secondary amino group, a hydroxyamino group, and a sulfonamide group, and precursors thereof.

$\alpha''$ represents a dialkylamino group or any of the groups as defined for $\alpha'$.

$G^{51}$ represents an alkylene group having from 1 to 3 carbon atoms.

a is 0 or 1.

$G^{52}$ represents a substituted or unsubstituted alkyl group having from 1 to 40 carbon atoms, or a substituted or unsubstituted aryl group having from 6 to 40 carbon atoms.

$G^{53}$ represents an electrophilic group, such as —CO—, and —CS—.

$G^{54}$ represents an oxygen atom, a sulfur atom, a selenium atom, or a nitrogen atom; in the case of the nitrogen atom, it may be substituted with a hydrogen atom, a substituted or unsubstituted group having from 1 to 10 cabon atoms, or an aromatic radical having from 6 to 20 carbon atoms.

$G^{55}$, $G^{56}$ and $G^{57}$ each represents a hydrogen atom, a halogen atom, a carbonyl group, a sulfamyl group, a sulfonamide group, an alkyloxy group having from 1 to 40 carbon atoms, or the same as defined for $G^{52}$; $G^{55}$ and $G^{56}$ may combine together to form a 5- to 7-membered ring.

$G^{56}$ may represent

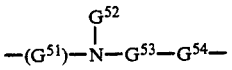

provided that at least one of $G^{52}$, $G^{55}$, $G^{56}$, and $G^{57}$ is a ballast group.

Representative examples of Y of this type are described in Japanese Patent Application (OPI) No. 63618/76.

Still other examples of Y which are suitable for the compounds of this type are the groups represented by formulae (CIX) and (CX).

(CIX)

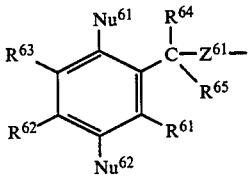

-continued (CX)

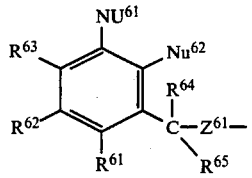

In above formulae (CIX) and (CX), $Nu^{61}$ and $Nu^{62}$ may be the same or different, and each represents a nucleophilic group or a precursor thereof.

$Z^{61}$ represents a divalent atom group which is electro-negative in relation to the carbon atom at which $R^{64}$ and $R^{65}$ are substituted.

$R^{61}$, $R^{62}$, and $R^{63}$ each represents a hydrogen atom, a halogen atom, an alkyl group, an alkoxyl group, or an acylamino group; when $R^{61}$ and $R^{62}$ are in an adjacent relation on the ring, they may combine with the remainder of the molecule, thereby forming a condensed ring, or $R^{62}$ and $R^{63}$ may combine together with the remainder of the molecule, thereby forming a condensed ring.

$R^{64}$ and $R^{65}$ may be the same or different, and each represents a hydrogen atom, a hydrocarbon group, or a substituted hydrocarbon group.

At least one of the substituents $R^{61}$, $R^{62}$, $R^{63}$, $R^{64}$ and $R^{65}$ has a sufficiently big ballast group, Ball, so as to make the compounds immobile.

Representative examples of Y of this type are described in Japanese Patent Application (OPI) Nos. 69033/78 and 130927/79.

Still other examples of Y which are suitable for the compounds of this type are the groups represented by formula (CXI).

(CXI)

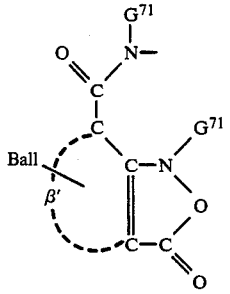

In above formula (CXI), Ball and $\beta'$ are the same as defined for formula (CIII).

$G^{71}$ represents an alkyl group (including a substituted alkyl group).

Representative examples of Y of this type are described in Japanese Patent Application (OPI) Nos. 111628/74 and 4819/77.

Compounds of another type as represented by the above formula (I) are nondiffusing image-forming compounds which do not release a dye by themselves, but release a dye upon reacting with a reducing agent. In this case, it is preferred to use a compound accelerating a redox reaction (a so-called electron donor) in combination.

Examples of Y which are suitable for the compounds of this type are the groups represented by formula (CXII):

(CXII)

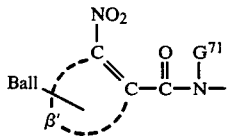

In formula (CXII), Ball and $\beta'$ are the same as defined for formula (CIII).

$G^{71}$ is a substituted or unsubstituted alkyl group.

Representative examples of Y of this type are described in Japanese Patent Application (OPI) Nos. 35533/78 and 110827/78.

Still other examples of Y which are suitable for the compounds of this type are the groups represented by formula (CXIII).

(CXIII)

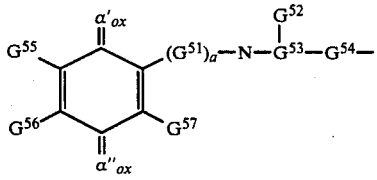

In formula (CXIII), $\alpha'_{ox}$ and $\alpha''_{ox}$ are each a group providing $\alpha'$ or $\alpha''$, respectively, upon of reduction.

$\alpha'$, $\alpha''$, $G^{51}$, $G^{52}$, $G^{53}$, $G^{54}$, $G^{55}$, $G^{56}$, and $G^{57}$ are the same as defined for formula (CVIII).

Representative examples of Y of this type are described in Japanese Patent Application (OPI) No. 110827/78, U.S. Pat. Nos. 4,356,249 and 4,358,525.

Other examples of Y which are suitable for the compounds of this type are the groups represented by formulae (CXIVA) and (CXIVB).

(CXIVA)

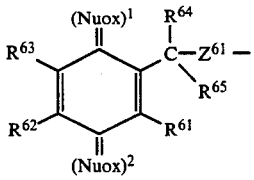

(CXIVB)

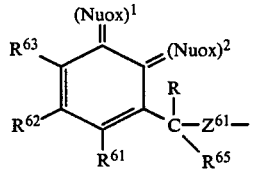

In formulae (CXIVA) and (CXIVB), $(Nuox)^1$ and $(Nuox)^2$ may be the same or different and are each an oxidized nucleophilic group.

The other symbols are the same as defined in formulae (CIX) and (CX).

Representative examples of Y of this type are described in Japanese Patent Application (OPI) Nos. 130927/79 and 164342/81.

In the patent references cited for formulae (CXII), (CXIII), (CXIVA), and (CXIVB), electron donors that can be used in combination are described.

Compounds of another type as represented by the formula (CI) are linked donor acceptor compounds. These compounds are nondiffusing image-forming compounds which release a diffusing dye on reacting with a donor acceptor in the presence of a base, but do not substantially release a dye when reacted with an oxidized developing agent.

Examples of Y which are effective for the compounds of this type are the groups represented by formula (CXV), for example.

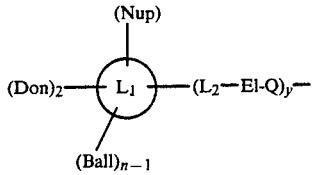

(CXV)

Representative examples of this type are described in Japanese Patent Application No. 60289/83.

In formula (CXV), n, x, y and z are each 1 or 2.

Don represents an electron donor, or a group containing the precursor portion of the electron donor.

$L^1$ represents an organic group connecting Nup to —$L_2$—El—Q or Don.

Nup represents a precursor of a nucleophilic group.

El is an electrophilic center.

Q is a divalent group.

Ball is a ballast group.

$L^2$ is a connecting group.

The ballast group is an organic ballast group capable of making a dye image-forming compound nondiffusing. This group preferably contains a hydrophobic group having from 8 to 32 carbon atoms. These organic ballast groups are linked to the dye image-forming compound, directly or through a connecting group (e.g., an imino bond, an ether bond, a thioether bond, a carbonamido bond, a sulfonamido bond, a ureiod bond, an ester bond, a carbamoyl bond, and a sulfamoyl bond, which may be used alone or in combination with each other).

Dye-providing substances may be used as mixtures comprising two or more thereof. Such mixtures include the case of two or more substances may be used to produce the same dye color, and the case in which two or more substances are used to produce black is included.

Representative examples of image-forming substances which are used in the present invention are described in the above-cited patent references.

Many of the image-forming substances form an image pattern of mobile dye in a light-sensitive material according to an exposed pattern when the material is heat developed. A method of transferring the image dye to a dye-fixing material (so-called diffusion transfer) to visualize it is described in the above-cited patent references and also in Japanese Patent Application Nos. 42092/83, 55172/83, etc.

In the present invention, the dye-providing substance can be introduced into light-sensitive materials according to known methods described, for example, in U.S. Pat. No. 2,322,027. In such cases, organic solvents having a high boiling point as described above may be used.

For example, the dye-providing substance is dissolved in an organic solvent having a high-boiling such as alkyl phthalate (e.g., dibutyl phthalate, dioctyl phthalate, etc.), a phosphate (diphenyl phosphate, triphenyl phosphate, tricresyl phosphate, dioctylbutyl phosphate, etc.), a citric ester (e.g., tributyl acetylcitrate), a benzoic ester (e.g., octyl benzoate), an alkylamide (e.g., diethyllaurylamide), a fatty acid ester (e.g., dibutoxyethyl succinate, dioctyl azelate, etc.), a trimesic ester (e.g., tributyl trimesate), etc. or an organic solvent having a boiling point of from about 30° C. to about 160° C. such as a lower alkyl acetate (e.g., ethyl acetate, butyl acetate, etc.), ethyl propionate, sec-butyl alcohol, methyl isobutyl ketone, β-ethoxyethyl acetate, methylcellosolve acetate, cyclohexanone or the like, then the resulting solution is dispersed in a hydrophilic colloid. The above-described organic solvents having high-boiling point may be used in combination with the organic solvents having a low boiling point.

A method of dispersing the substance using a polymer described in Japanese Patent Publication No. 39853/76 and Japanese Patent Application (OPI) No. 59943/76 may also be employed. In dispersing the dye-providing substance in a hydrophilic colloid, various surfactants may be used. As such surfactants, those given to as surfactants in other part of this specification may be used.

In the present invention, the organic solvent having a high-boiling point is used in an amount of not more than 10 g, preferably not more than 5 g, per g of the dye-providing substance used.

In the present invention, it is preferable to use a reducing substance in the light-sensitive material. Preferred reducing substances include known reducing agents and the above-described reducing dye-providing substances.

Examples of reducing agents to be used in the present invention include the following: hydroquinon compounds (e.g., hydroquinone, 2,5-dichlorohydroquinone, 2-chlorohydroquinone, etc.), aminophenol compounds (e.g., 4-aminophenol, N-methylaminophenol, 3-methyl-4-aminophenol, 3,5-dibromoaminophenol, etc.), catechol compounds (e.g., catechol, 4-cyclohexylcatechol, 3-methoxycatechol, 4-(N-octadecylamino)catechol, etc.), phenylenediamine compounds (e.g., N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.), etc.

More preferable examples of the reducing agents are 3-pyrazolidone compounds (e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, etc.).

Combinations of various developing agents as described in U.S. Pat. No. 3,039,869 may be used as well.

In the present invention, the reducing agent is generally added in an amount of from 0.01 to 20 mols, and particularly preferably from 0.1 to 10 mols, per mol of silver.

In the present invention, various dye-releasing aids can be used. The dye-releasing aids are compounds which are basic substances and are capable of activating development or compounds having a so-called nucleophilic property, and include bases or base precursors.

The base precursors according to the present invention can also serve as dye-releasing aids, but other bases or base precursors can be additionally used.

The dye-releasing aids can be used in either a light-sensitive material or a dye-fixing material. When the dye-releasing aids are used in the light-sensitive material, it is particularly preferred to use a base precursor.

In the present invention, various development stopping agents can be used for the purpose of obtaining an always constant image irrespective of changes in processing temperature and time at the step of development.

The term "development stopping agent" as used herein means a compound which, after appropriate development, quickly neutralizes or reacts with a base, thereby decreasing the concentration of the base in the film and stopping the development. In more detail, acid precursors which release an acid on heating, or compounds which react with the coexisting base, thereby decreasing the concentration of the base, can be used. Compounds of the former type include oximesters as described in Japanese Patent Application Nos. 216928/83 and 48305/84, and compounds releasing an acid through the Lossen rearrangement as described in Japanese Patent Application No. 85834/84. Compounds of the latter type that reacts with a base on heating include compounds as described in Japanese Patent Application No. 85836/84.

The above development stopping agents are preferred since they are particularly effective when the base precursor is used.

In this case, the molar ratio of base precursor to acid precursor (base precursor/acid precursor) is preferably from 1/20 to 20/1, and more preferably from 1/5 to 5/1.

Binders to be used in the present invention may be used alone or in combination. Hydrophilic binders may be used. Typical examples of the hydrophilic binder are transparent or semitransparent hydrophilic binders and include natural substances such as proteins (e.g., gelatin, gelatin derivatives and cellulose derivatives) and polysaccharides (e.g., starch, gum arabic, etc.) and synthetic polymer substances such as water-soluble polyvinyl compounds (e.g., polyvinylpyrrolidone, acrylamide polymer, etc.). Other synthetic polymer substances include dispersed vinyl compounds in a latex form, which serve to increase dimensional stability of the photographic materials.

Also, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trichloroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having $\alpha$-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420.

Further, azolethio ether and blocked azolinethione compounds as disclosed in Belgian Patent 768,071, 4-aryl-1-carbamyl-2-tetrazoline-5-thione compounds as disclosed in U.S. Pat. No. 3,893,859, and the compounds disclosed in U.S. Pat. Nos. 3,839,041, 3,844,788 and 3,877,940 can be preferably used.

The light-sensitive material (photosensitive material) of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above-described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above-described manner, migration of additives among constituent layers of a heat developable photosensitive material can be reduced. Therefore, such distribution of additives is of advantage to some cases.

The heat developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include sun-light, strobo, flash, tungsten lamps, mercury lamps, halogen lamps such as iodine lamps, xenon lamps, laser light sources, CRT light sources, plasma light source, fluorescent tubes and light-emitting diodes, etc.

As the heating means, a simple heat plate, iron, heat roller, heat generator utilizing carbon or titanium white, etc., or analogues thereof may be used.

Supports to be used in the light-sensitive material of the present invention must withstand the processing temperatures used. As general supports, acetylcellulose film, cellulose ester film, polyvinyl acetal film, polystyrene film, polycarbonate film, polyethylene terephthalate film, and related films or resin materials are used as well as glass, paper, metal, and analogs thereof. Paper supports laminated with a polymer such as polyethylene may also be used. Polyesters described in U.S. Pat. Nos. 3,634,089 and 3,725,070 are preferably used.

In the photographic light-sensitive material and the dye-fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihdyroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc. which are used individually or as a combination thereof.

When the dye-providing substance which releases imagewise a mobile dye is used, the transfer of dyes from the light-sensitive layer to the dye-fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye-fixing material, it is not necessary to supply the transfer assistant from the outside. In this case, the above described dye transfer assistant may be incorporated into the material in the form of water of crystallization or microcapsules or as a precursor which releases a solvent at a high temperature. More preferred process is a process wherein a hydrophilic thermal solvent which is solid at an ambient temperature and melts at a high temperature is incorporated into the light-sensitive material or the dye-fixing material. The hydrophilic thermal solvent can be incorporated either into any of the light-sensitive material and the dye-fixing material or into both of them. Although the solvent can be incorporated into any of the emulsion layer, the intermediate layer; the protective layer and the dye-fixing layer, it is preferred to incorporate it into the dye-fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants and so on, are those described in U.S. Pat. Nos. 4,500,626, 4,478,927, 4,463,079, and Japanese Patent Application No. 28928/83 (corresponding to U.S. patent application Ser. No. 582,655 filed on Feb. 23, 1984) and U.S. Pat. No. 4,503,137. Methods for the exposure and so on cited in the desired patents can be employed in the present invention also.

In accordance with the present invention, the compound of formula (I) is incorporated as a base precursor in a heat-developable light-sensitive material, and, therefore, a high density image can be obtained in a short period of time. Almost no change in photographic performance is observed, i.e., its storage stability is excellent.

The present invention is described below in more detail with reference to the following examples.

EXAMPLE 1

Preparation of Silver Iodobromide Emulsion

A mixture of 40 g of gelatin and 26 g of KBr was dissolved in 3,000 ml of water. The resulting solution was stirred while maintaining it at 50° C.

Then a solution of 34 g of silver nitrate in 200 ml of water and 200 ml of a solution prepared by dissolving 0.02 g of Dye I as described hereinafter in 300 ml of methanol were added at the same time to the above solution over 10 minutes.

Then a solution of 3.3 g of KI in 100 ml of water was added to the solution over 2 minutes.

The silver iodobromide emulsion thus prepared was adjusted in pH, precipitated, and then freed of excessive salts.

The emulsion was then adjusted to pH 6.0 to yield 400 g of a silver iodobromide emulsion.

Preparation of Gelatin Dispersion of Coupler

A mixture of 5 g of 2-dodecylcarbamoyl-1-naphthol, 0.5 g of sodium 2-ethylhexyl succinate sulfonate, and 2.5 g of tricresyl phosphate (TCP) was dissolved in 30 ml of ethyl acetate. The resulting solution was mixed with 100 g of a 10% gelatin solution and dispersed therein for 10 minutes at 10,000 rpm by the use of a homogenizer.

Dye I

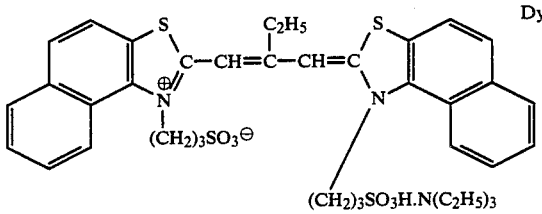

A coating solution having the composition shown below was coated on a polyethylene terephthalate support in a wet film thickness of 60 μm and then dried to prepare a light-sensitive material.

Composition of Coating Solution (a) Silver iodobromide emulsion: 10 g
(b) Gelatin dispersion of coupler: 3.5 g
Base precursor (1) of the present invention: 0.24 g
(d) 10% Aqueous solution of gelatin: 5 g
(e) Solution of 0.2 g of 2,6-dichloro-p-aminophenol in 17 ml of water The above-prepared light-sensitive material was exposed imagewise for 5 seconds at 2,000 lux by the use of a tungsten lamp. Then the light-sensitive material was uniformly heated for 20 seconds on a heat block maintained at 150° C., whereupon a negative cyan image was obtained. The density of the image was measured with a Macbeth transmission densitometer (TD-504). The minimum density (Dmin) was 0.16 and the maximum density (Dmax) was 2.15.

It can thus be seen that the compound of the present invention provides a desirable high density.

EXAMPLE 2

In this example, the same silver iodobromide emulsion as used in Example 1 and a dye-providing substance dispersion as described below were used.

Preparation of Dye-Providing Substance Dispersion

A mixture of 5 g of the following dye-providing substance (CI-2), 0.5 g of sodium 2-ethylhexyl succinate sulfonate as a surface active agent, and 5 g of tricresyl phosphate (TCP) was dissolved in 30 ml of ethyl acetate by heating at about 60° C. The solution thus prepared was mixed with 100 g of a 10% gelatin solution and dispersed therein for 10 minutes at 10,000 rpm by the use of a homogenizer.

CI-2

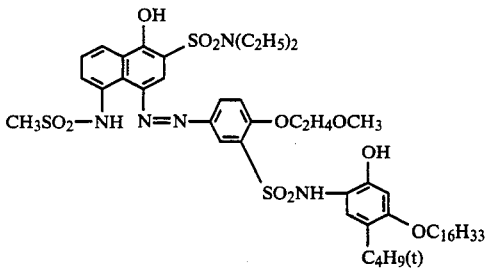

| Preparation of Light-Sensitive Coating Solution | | |
|---|---|---|
| (a) | Light-sensitive silver iodobromide emulsion (same as used in Example 1) | 25 g |
| (b) | Dispersion of dye-providing substance (CI-2) | 33 g |
| (c) | 5% Aqueous solution of compound having the formula | 10 ml |
| | 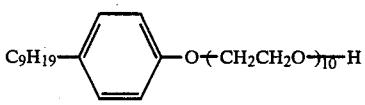 | |
| (d) | 10% Aqueous solution of compound as shown below: $H_2NSO_2N(CH_3)_2$ | 4 ml |
| (e) | Base precursor (1) of the present invention | 2.3 g |
| (f) | Water | |

The above ingredients (a) to (f) were heated and dissolved, and then coated on a polyethylene terephthalate support in a wet film thickness of 30 μm.

The light-sensitive material thus prepared was exposed imagewise for 10 seconds at 2,000 lux by the use of a tungsten lamp. The light-sensitive material was then uniformly heated for 20 seconds on a heat block maintained at 150° C. This material is referred to as Sample A.

A light-sensitive material (Sample B) was prepared in the same manner as above except that the compound of Component (e) was replaced with 1.8 g of guanidine trichloroacetic acid.

A light-sensitive material (Sample C) was prepared in the same manner as above except that the compound of Component (e) was replaced with 2.1 g of guanidine phenylsulfonyl acetate.

A light-sensitive material (Sample D) was prepared in the same manner as above except that the compound of Component (e) was replaced with 2.0 g of guanidine phenylpropionate.

Preparation of Image-Receiving Material including Image-Receiving Layer

A methyl acrylate/N,N,N-trimethyl-N-vinylbenzyl ammonium chloride (1:1) copolymer (10 g) was dissolved in 200 ml of water, and then uniformly mixed with 100 g of a 10% lime-treated gelatin. The resulting mixture was uniformly coated in a wet film thickness of 90 μm on a paper support laminated with polyethylene in which titanium dioxide had been dispersed, and then dried to prepare an image-receiving material.

The image-receiving material was soaked in water, and thereafter, each of the light-sensitive materials (Samples A, B, C, and D) was superposed on the image-receiving material in such a manner that the coatings were in contact with each other.

The assembly was then heated for 6 seconds on a heat block maintained at 80° C. On peeling apart the image-receiving material from the light-sensitive material, a negative magenta image was obtained on the image-receiving material. The maximum density (Dmax) and minimum density (Dmin) of the negative image were measured with a Macbeth reflection densitometer (RD-519).

Samples A, B, C, and D were stored at 50° C. for 4 days, and, thereafter, were subjected to the same processing as above and measured for the maximum density (D'max) and minimum density (D'min).

The results are shown in Table 1.

TABLE 1

| Sample | Dmax | Dmin | D'max | D'min |
|---|---|---|---|---|
| A (Example of the present invention) | 2.11 | 0.18 | 2.10 | 0.20 |
| B (Comparative example) | 2.14 | 0.58 | Entirely fogged | Entirely fogged |
| C (Comparative example) | 1.28 | 0.16 | 1.33 | 0.20 |
| D (Comparative example) | 2.10 | 0.20 | 2.12 | 0.75 |

It can be seen from Table 1 that the base precursor of the present invention provides a high maximum density and a low minimum density, and that the storage stability is good.

EXAMPLE 33

The procedure of Example 2 was repeated wherein the base precursors shown in Table 2 were used.

The results are shown in Table 2.

TABLE 2

| | Base Precursor | | | | | |
|---|---|---|---|---|---|---|
| sample | Type | Amount (g) | Dmax | Dmin | D'max | D'min |
| E | Compound (2) | 2.3 | 2.08 | 0.19 | 2.06 | 0.21 |
| F | Compound (3) | 2.2 | 2.12 | 0.20 | 2.09 | 0.22 |
| G | Compound (6) | 2.4 | 2.14 | 0.19 | 2.15 | 0.23 |
| H | Compound (8) | 2.4 | 2.10 | 0.18 | 2.12 | 0.22 |

It can be seen from Table 2 that the base precursor of the present invention provides a high maximum density and a low minimum density, and that the storage stability is excellent.

EXAMPLE 4

In this example, an organosilver salt oxidizing agent was used.

Preparation of Silver Benzotriazole Emulsion

A mixture of 28 g of gelatin and 13.2 g of benzotriazole was dissolved in 3,000 ml of water. The resulting solution was stirred while maintaining it at 40° C. Then a solution of 17 g of silver nitrate in 100 ml of water was added to the above solution over 2 minutes.

This silver benzotriazole emulsion was precipitated, and then freed of excess salts. Then it was adjusted to a pH of 6.0 to yield 400 g of a silver benzotriazole emulsion.

Using this silver benzotriazole emulsion, the following light-sensitive coating material was prepared.

| | | |
|---|---|---|
| (a) | Silver iodobromide emulsion (same as used in Example 1) | 20 g |
| (b) | Silver benzotriazole emulsion | 10 g |
| (c) | Dispersion of dye-providing substance (same as used in Example 2) | 33 g |
| (d) | 5% Aqueous solution of a compound having the formula 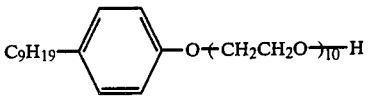 | 10 ml |
| (e) | 10% Aqueous solution of a compound having the formula $H_2NSO_2N(CH_3)_2$ | 4 ml |
| (f) | Base precursor (1) of the present invention | 2.5 g |
| (g) | Gelatin dispersion of an acid precursor as shown below | 8 ml |
| (h) | Water | 12 ml |

The gelatin dispersion of the acid precursor, Component (g), was prepared as follows.

A compound as shown below in an amount of 10 g was added to 100 g of a 1% aqueous solution of gelatin, and the resulting mixture was pulverized for 10 minutes in a mill using 100 g of glass beads having an average particle diameter of about 0.6 mm. The glass beads were separated by filtration to obtain the desired dispersion of the acid precursor in gelatin.

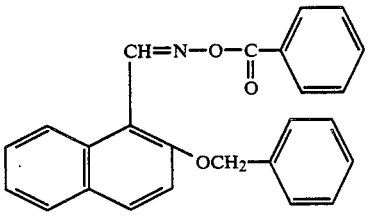

The above components (a) to (g) were mixed and, thereafter, processed in the same manner as in Example 2. The results are shown below.

| Sample | | Maximum Density | Minimum Density |
|---|---|---|---|
| (A') | Containing the base precursor of the present invention | 2.08 | 0.16 |
| (B') | Containing guanidine trichloroacetic acid (Comparative example) | 2.33 | 0.61 |
| (C') | Containing guanidine phenylsulfonylacetate (Comparative example) | 1.47 | 0.19 |

It can be seen from the above results that the base precursor of the present invention provides a high maximum density and a low minimum density.

The above samples (A), (B), and (C) were stored for 4 days under the conditions of temperature of 40° C. and humidity of 80%. Thereafter they were processed in the same manner as above. The results were as follows.

| Sample | Maximum Density | Minimum Density |
|---|---|---|
| (A') | 2.04 | 0.18 |
| (B') | Entirely fogged | |
| (C') | 1.46 | 0.30 |

It can be seen from the above results that the storage stability of the light-sensitive material of the present invention is good even under high temperature and high humidity conditions.

EXAMPLE 5

Preparation of Silver Benzotriazole Emulsion containing Light-Sensitive Silver Bromide A mixture of 6.5 g of benzotriazole and 10 g of gelatin was dissolved in 1,000 ml of water. The resulting solution was stirred while maintaining it at 50° C. Then a solution of 8.5 g of silver nitrate in 100 ml of water was added to the above-prepared solution over 2 minutes.

A solution of 1.2 g of potassium bromide in 50 ml of water was added over 2 minutes. The emulsion thus prepared was precipitated by adjusting the pH and freed of excessive salts. This emulsion was adjusted to pH 6.0 to yield 200 g of the desired emulsion.

Preparation of Dispersion of Dye-Providing Substance in Gelatin

A mixture of 6 g of a dye-providing substance CI-16 having the following formula CI-16

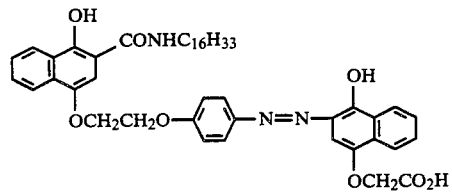

0.5 g of sodium 2-ethylhexyl succinate sulfonate as a surface active agent, and 4 g of tricresyl phosphate (TCP) was dissolved in 20 ml of cyclohexanone by heating at about 60° C. to prepare a uniform solution. This solution was mixed with 100 g of a 10% solution of lime-treated gelatin, stirred, and then dispersed therein for 10 minutes at 10,000 rpm by the use of a homogenizer.

Preparation of Light-Sensitive Coating Solution (a) Silver benzotriazole emulsion containing light-sensitive silver bromide: 10 g
(b) Dispersion of dye-providing substance: 3.5 g
(c) Base precursor (1) of the present invention: 0.24 g
(d) 10% Aqueous solution of gelatin: 5 g
(e) Solution prepared by dissolving 200 ml of 2,6-dichloro-4-aminophenol in 4 ml of methanol The above components (a) to (e) were mixed, dissolved by heating, and then coated on a 180 μm thick polyethylene terephthalate film in a wet film thickness of 30 μm. This coated material was dried, and then exposed imagewise for 10 seconds at 2,000 lux by the use of a tungsten lamp. Then the material was uniformly heated for 20 seconds on a heat block maintained at 150° C.

The same image-receiving material as used in Example was used. This image-receiving material was superposed on the light-sensitive material and processed in the same manner as above. A negative magenta color image was obtained on the image-receiving material. The density of the negative image was measured with a Macbeth reflection densitometer (RD-519). The maximum density was 2.06 and the minimum density was 0.20.

It can be seen from the above results that the compound of the present invention exhibits an excellent effect.

EXAMPLE 6

Preparation of Gelatin Dispersion of Dye-Providing Substance CI-17

A mixture of 8 g of a dye-donating substance CI-17 having the formula

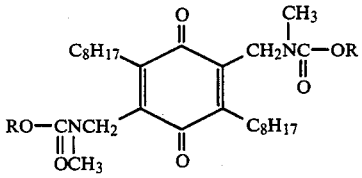

CI-17 wherein R is

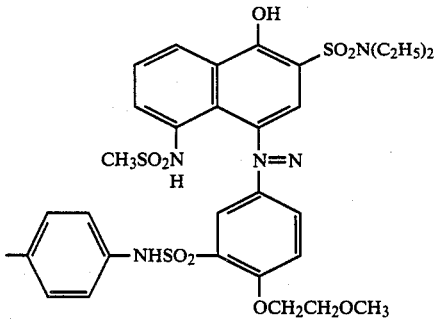

4 g of an electron-donating substance having the following formula

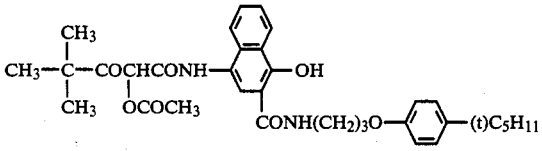

0.5 g of sodium 2-ethylhexyl succinate sulfonate, and 10 g of tricresyl phosphate (TCP) was dissolved in 20 ml of cyclohexane by heating at about 60° C. The resulting solution was mixed with 100 g of a 10% gelatin solution, stirred, and then dispersed for 10 minutes at 10,000 rpm by the use a homogenizer.

| Preparation of Light-Sensitive Coating Solution | | |
|---|---|---|
| (a) | Silver benzotriazole emulsion containing light-sensitive silver bromide (same as used in Example 5) | 10 g |
| (b) | Dispersion of dye-providing substance (as prepared in this example) | 3.5 g |
| (c) | Base precursor (1) of the present invention | 0.35 g |
| (d) | 5% Aqueous solution of a compound having the formula 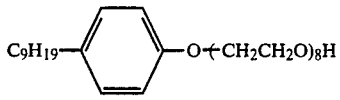 | 1.5 ml |

These components (a) to (d) were added to 4 ml of water and dissolved therein by heating. The solution thus prepared was coated on a polyethylene terephthalate film in a wet film thickness of 30 μm and then dried to prepare a light-sensitive material.

This light-sensitive material was exposed imagewise for 10 seconds at 2,000 lux by the use of a tungsten lamp. Then the material was uniformly heated for 40 seconds on a heat block maintained at 140° C.

The same image-receiving material as used in Example 2 was soaked in water and then superposed on the above-heated light-sensitive material in such a manner that their coatings were in contact with each other. A positive magenta color image was formed on the image-receiving material. The density of the positive image was measured with a Macbeth reflection densitometer (RD-519). As densities to green light, the maximum density was 2.02 and the minimum density was 0.31.

It can be seen from the above results that the base precursor of the present invention is very effective.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material containing a compound represented by formula (I) as a base precursor

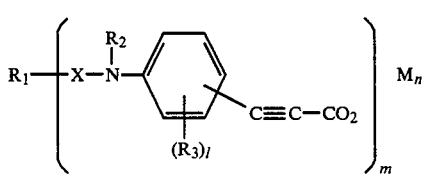

(I)

wherein $R_1$ represents a hydrogen atom, a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, a substituted or unsubstituted heterocyclic group, a substituted or unsubstituted alkylene group, a substituted or unsubstituted cycloalkylene group, a substituted or unsubstituted alkenylene group, a substituted or unsubstituted alkynylene group, a substituted or unsubstituted aralkylene group, a substituted or unsubstituted arylene group, or a substituted or unsubstituted divalent heterocyclic group; $R_2$ represents a hydrogen atom, a substituted or unsubstituted alkyl group; $R_3$ represents an alkyl group, an alkoxyl group, a halogen atom, an acylamino group, a sulfonylamino group, an alkylamino group, a dialkylamino group, an alkylsulfonyl group, an arylsulfonyl group, a cyano group, a substituted or unsubstituted carbamoyl group, a substituted or unsubstituted sulfamoyl group or an alkoxycarbonyl group; X represents a divalent group selected from $$-\overset{O}{\overset{\|}{C}}-,\ -O-\overset{O}{\overset{\|}{C}}-,\ -\overset{R_4}{\overset{|}{N}}-\overset{O}{\overset{\|}{C}}-$$

(wherein $R_4$ represents a hydrogen atom, a substituted or unsubstituted alkyl group), $$-SO_2-,\ -\overset{R_4}{\overset{|}{N}}-SO_2-,\ -O-\overset{O}{\overset{\|}{\underset{\underset{OR_5}{|}}{P}}}-$$

(wherein $R_5$ represents a substituted or unsubstituted alkyl group), and $$-\overset{O}{\overset{\|}{\underset{\underset{R_1}{|}}{P}}}-;$$

M represents an alkali metal, an alkaline earth metal, a quaternary ammonium group, or an ammonium group represented by BH (wherein B represents an organic base); l is an integer of 0 to 3; and m and n are each an integer of 1 or 2, such that the electric charge of carboxylate anion is equivalent to that of M.

2. A heat-developable light-sensitive material as in claim 1, wherein $R_1$ represents a hydrogen atom, an alkyl group having from 1 to 11 carbon atoms, a substituted or unsubstituted aryl group, a cycloalkyl group having from 5 to 8 carbon atoms, an aralkyl group having from 7 to 12 carbon atoms, an alkylene group having from 1 to 8 carbon atoms, an arylene group having from 6 to 10 carbon atoms, a styryl group, a 2-thienyl group, or a 2-furyl group.

3. A heat-developable light-sensitive material as in claim 1, wherein $R_2$ represents a hydrogen atom.

4. A heat-developable light-sensitive material as in claim 1, wherein $R_3$ represents a methyl group, a methoxy group, a methoxyethoxy group, a halogen atom, an acrylamino group having from 1 to 8 carbon atoms, an alkylsulfonylamino group having from 1 to 8 carbon atoms, or an arylsulfonylamino group having from 6 to 7 carbon atoms.

5. A heat-developable light-sensitive material as in claim 1, wherein X represents $$-\overset{O}{\overset{\|}{C}}-,\ -O-\overset{O}{\overset{\|}{C}}-,\ -NH-\overset{O}{\overset{\|}{C}}-,\ -SO_2,\ \text{or}\ -NHSO_2-.$$

6. A heat-developable light-sensitive material as in claim 1, wherein M is $Na^{\oplus}$, $K^{\oplus}$, $Cs^{\oplus}$, $Ba^{\oplus}$, a quaternary ammonium ion salt having a total number of carbon atoms of 8 or less, or an ammonium ion group represented by BH, wherein B represents an organic salt group.

7. A heat-developable light-sensitive material containing a compound represented by formula (I) as a base precursor

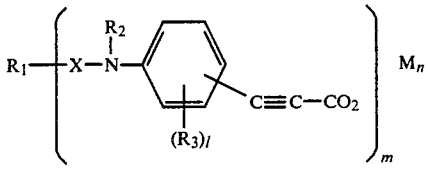

(I)

wherein $R_1$ represents a hydrogen atom, an alkyl group having from 1 to 11 carbon atoms, a substituted or unsubstituted aryl group, a cycloalkyl group having from 5 to 8 carbon atoms, an aralkyl group having from 7 to 12 carbon atoms, an alkylene group having from 1 to 8 carbon atoms, an arylene group having from 6 to 10 carbon atoms, a styryl group, a 2-thienyl group, or a 2-furyl group; $R_2$ represents a hydrogen atom; $R_3$ represents a methyl group, a methoxy group, a methoxyethoxy group, a halogen atom, an acrylamino group having from 1 to 8 carbon atoms, an alkylsulfonylamino group having from 1 to 8 carbon atoms, or an arylsulfonylamino group having from 6 to 7 carbon atoms; X represents $$-\overset{O}{\overset{\|}{C}}-,\ -O-\overset{O}{\overset{\|}{C}}-,\ -NH-\overset{O}{\overset{\|}{C}}-,\ -SO_2,\ \text{or}\ -NHSO_2-;$$

M is $Na^{\oplus}$, $K^{\oplus}$, $Cs^{\oplus}$, $Ba^{\oplus}$, a quaternary ammonium ion salt having a total number of carbon atoms of 8 or less, or an ammonium ion group represented by BH, wherein B represents an organic salt group.

8. A heat-developable light-sensitive material as in claim 1, wherein the amount of the base precursor is from 0.01 to 40 wt%, based on the weight of the dry light-sensitive material.

9. A heat-developable light-sensitive material as in claim 2, wherein the amount of the base precursor is from 0.01 to 40 wt%, based on the weight of the dry light-sensitive material.

10. A heat-developable light-sensitive material as in claim 3, wherein the amount of the base precursor is from 0.01 to 40 wt%, based on the weight of the dry light-sensitive material.

11. A heat-developable light-sensitive material as in claim 4, wherein the amount of the base precursor is from 0.01 to 40 wt%, based on the weight of the dry light-sensitive material.

12. A heat-developable light-sensitive material as in claim 5, wherein the amount of the base precursor is from 0.01 to 40 wt%, based on the weight of the dry light-sensitive material.

13. A heat-developable light-sensitive material as in claim 6, wherein the amount of the base precursor is from 0.01 to 40 wt%, based on the weight of the dry light-sensitive material.

14. A heat-developable light-sensitive material as in claim 7, wherein the amount of the base precursor is from 0.01 to 40 wt%, based on the weight of the dry light-sensitive material.

15. A heat-developable light-sensitive material as in claim 1, wherein said heat-developable light-sensitive material is a heat-developable silver halide light-sensitive material.

16. A heat-developable light-sensitive material as in claim 7, wherein said heat-developable light-sensitive material is a heat-developable silver halide light-sensitive material.

* * * * *